US005439413A

United States Patent [19]

Lägler

[11] Patent Number: 5,439,413

[45] Date of Patent: Aug. 8, 1995

[54] FLOOR WORKING MACHINE

[75] Inventor: Eugen Lägler, Güglingen-Frauenzimmern, Germany

[73] Assignee: Eugen Lägler GmbH, Güglingen-Frauenzimmern, Germany

[21] Appl. No.: 224,979

[22] Filed: Apr. 8, 1994

[30] Foreign Application Priority Data

Apr. 10, 1993 [DE] Germany ..... 43 11 869.0

[51] Int. Cl.[6] ..... B24B 7/18

[52] U.S. Cl. ..... 451/353; 451/357

[58] Field of Search ..... 451/350, 353, 357, 271

[56] References Cited

U.S. PATENT DOCUMENTS 1,836,542 12/1931 Miller ..... 451/271
2,074,111 3/1937 Heichert ..... 451/271
4,862,548 9/1989 Sergio ..... 15/49 R
5,259,085 11/1993 Marafante et al. ..... 15/98

FOREIGN PATENT DOCUMENTS 1705039 8/1955 Germany .
1779514 5/1958 Germany .
786813 11/1957 United Kingdom .

*Primary Examiner*—Robert A. Rose
*Attorney, Agent, or Firm*—Browdy and Neimark

[57] ABSTRACT

A floor working machine for the treatment of the surface of floors and more especially a floor sanding machine comprises a work plate which rotates during operation. The work plate is connected in a manner transmitting rotation with a holding part arranged above it coaxially, such holding part bearing against the work plate with at least a part of the weight of the machine and being driven by the machine's motor. The holding part is supported adjacent to the center of rotation on the work plate. In this respect work plate is able to be pivoted with a freedom of movement similar to that provided by a ball joint to allow for possible unevenness of the floor. Work plate is arranged furthermore outside the support point opposite to the holding part at a distance allowing the pivotal motion of the work plate and is attached at several attachment points to the holding part, in each case with the necessary degree of axial play.

15 Claims, 2 Drawing Sheets

Fig. 2
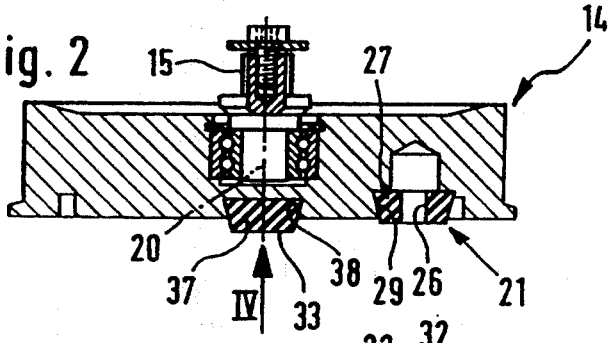
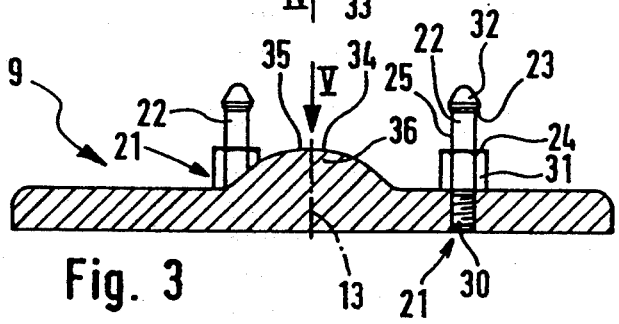
Fig. 3
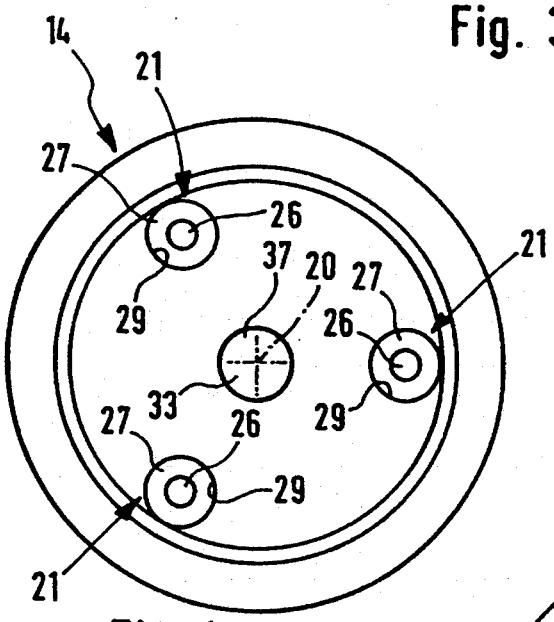
Fig. 4
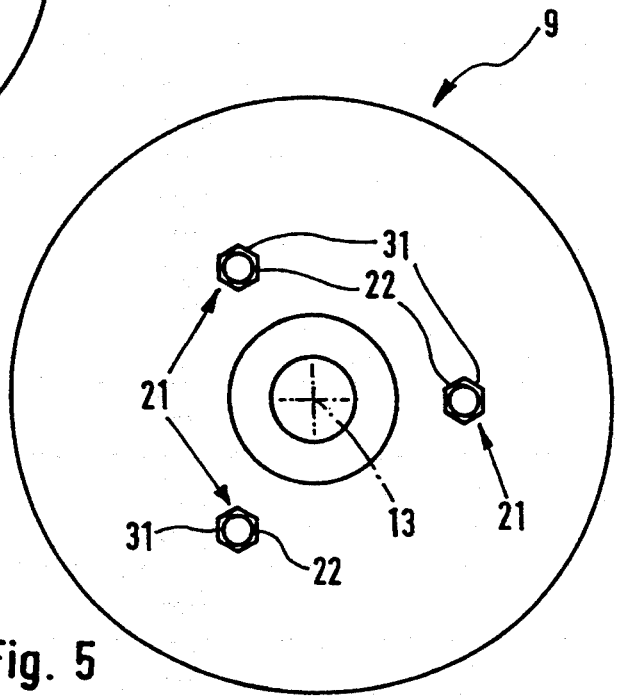
Fig. 5

FLOOR WORKING MACHINE

BACKGROUND OF THE INVENTION

The invention relates to a floor working machine for the surfaces of Floors and more particularly to a floor sanding machine comprising at least one rotary work plate which is adapted to perform such working or processing of the Floor during operation by means of a work means arranged on it, and is mounted on the lower side of the machine and which is connected for the transmission of rotation with a holding part, which is arranged coaxially over it, bears with at least a part of the weight of the machine on the work plate and is adapted to be driven by a motor of the machine.

Such a machine may be utilized for the sanding and brushing of floors, more especially wooden floors such as parquet floors, for the removal of any dirt adhering to the floor such as for example remains of fitted carpets and adhesives, and for the polishing of floors and the like. Such machines as a rule possess a chassis so that they can be moved over the floor by pushing or pulling. In this respect the work plates and the support wheels are so set in level in relation to each other that the work means applied to the lower side of the plate is planted on the floor and is then loaded by the weight of the machine to the extent that the weight is not taken up by the chassis or running gear.

If a conventional floor working machine is employed on an uneven, undulating floor the results generally leave to be desired. When a working plate arrives at a depression in the floor it will move over it leaving the depression more or less unprocessed, dependent on the depth thereof. When on the contrary it arrives at a projecting part of the floor there is the danger that the edge of the plate will plow into the surface of the floor.

SHORT SUMMARY OF THE INVENTION

One object of the invention is consequently to provide a floor processing or floor working machine of the type initially mentioned, which even when employed on undulating floors is still able to operate satisfactorily.

In accordance with the invention this object is to be attained by a floor working machine of the type in question since the holding part bears on the work plate at a support point adjacent to the center of rotation and the work plate is able to be pivoted in a manner similar to the moving part of a ball joint to a degree corresponding to the extent of possible unevenness in the floor and the work plate is arranged radially outside such support point opposite to the holding part with a clearance allowing pivoting of the work plate and is suspended from the holding part, in each case with respective axial play, at positions of attachment on the holding part distributed around the central support point.

It is in this manner that the respective work plate can automatically adapt itself to any unevenness in the floor and can assume a sloping position in accordance with local variations in the form of the floor so that it is able to follow the undulating form of the floor.

In this respect such pivoting is not opposed by any force due to the weight of the machine, since the weight of the machine is practically only transmitted to the work plate at the said point of support and the suspended attachment of the work plate only has to ensure that the plate is unable to drop off the machine. If the work plate assumes an oblique setting it may move at the points of attachment (at which the pivotal movement makes itself felt) more or less free of load owing to the axially movable bearing arrangement. This leads to an unimpeded and hence practically immediate adjustment of the work plate to the local slope in the floor.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

FIG. 2 shows the holding part, constituted by a belt pulley, of the machine in accordance with FIG. 1 as a separate view corresponding to the section of FIG. 1.

FIG. 3 shows the work plate of the machine in accordance with FIG. 1, also in a section corresponding to FIG. 1, as a separate view.

FIG. 4 shows the holding part as a separate view in the direction of viewing from below as indicated by the arrow IV in FIG. 2.

FIG. 5 shows the work plate as a separate view looking down onto the same in accordance with the arrow V in FIG. 3.

DETAILED ACCOUNT OF WORKING EMBODIMENT OF THE INVENTION

Figure 1:
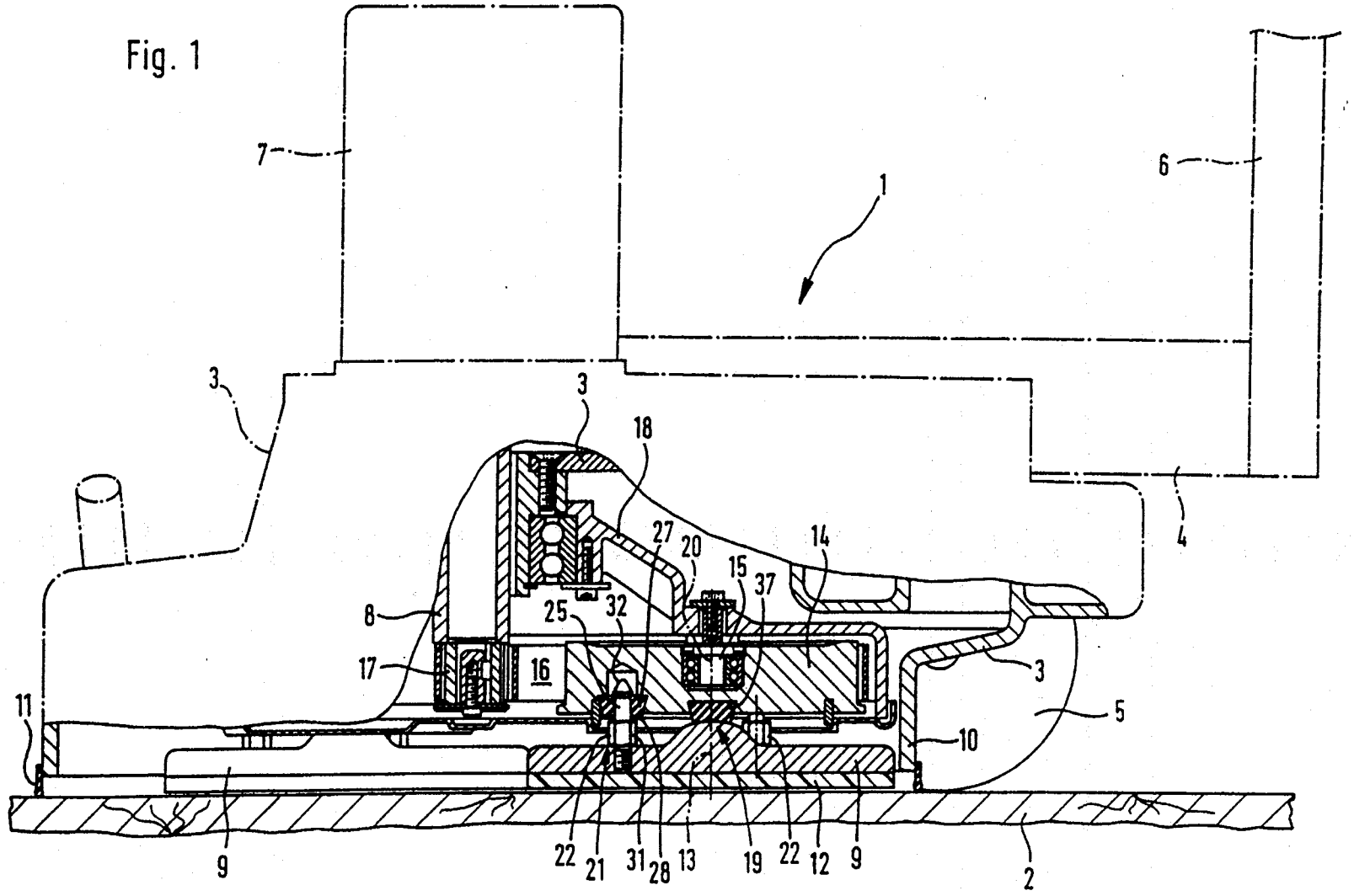
FIG. 1 shows a floor working machine designed in accordance with the invention as seen from below with the outline indicated in chain lines, the part of the machine relevant for the invention appearing in a vertical section taken through one of the work plates.

The floor processing or working machine appearing from the drawing in the form of a floor sanding machine 1 serves for the surface treatment of floors 2. Herein the word floor more particularly means a wooden floor and primarily a parquet floor, whose surface is to be run down, i.e. given a final grinding or sanding treatment. Dependent on the work means of the machine acting on the floor, it may be a question of brushing, polishing or a similar process for treatment of the floor surface instead of sanding.

The machine 1 comprises a housing 3, which is mounted on a chassis 4 having wheels 5, a handle 6 projecting upwards from the chassis 4 by which the user may hold the machine so that the machine 1 can be pushed or pulled over the floor 2 while running on the wheels 5.

The machine 1 furthermore possesses a motor 7 borne by the machine housing 3, which in the working embodiment is an electric motor, and which drives a drive shaft 8 extending downwards from the motor.

On the lower side of the machine there are three work plates 9 arranged generally in a triangle in relation to each other, of which one is illustrated in section, whereas one of the two other work plates 9 is visible in side elevation. The third work plate is, in terms of FIG. 1, above the plane of the drawing in a position covering the last named work plate 9. The totality of the work plates is enclosed by an annular housing extension 10, which ends a little above the floor 2 and may bear a downwardly projecting sealing lip 11 in engagement with the floor and which is to prevent the escape of dust produced by the work plates into the surroundings. On the lower side of the work plates the previously mentioned work means 12 is arranged, which in the present working embodiment is a sanding means making it possible for the respective work plate 9 to work on the floor 2.

The levels of the wheels 5 and of the work plates 9 are so set in relation to one another that the work plates 9 are thrust against the floor 2 by the weight of the machine to the extent that it is not taken up by the wheels 5.

When the motor 7 is turned on each work plate 9 will rotate about itself, that is to say about its axis of rotation 13, it then performing the operation of sanding or the like on the floor. In this respect each work plate 9 is drivingly connected with a holding part 14 arranged coaxially above it and driven by the machine motor 7 and furthermore transmitting the weight of the machine to the respective work plate 9 in the course of operation. The holding part 14 is designed as a circular part in accordance with its purpose of use and is bearinged on a bearing pin 15 secured to the housing. The drive arrangement for the holding parts 14—corresponding to the number of the work plates the machine possesses three such holding parts 14—is by means of a toothed belt 16 or is by means of another suitable belt, which is connected with the drive shaft 8 and in the working embodiment is in driving engagement with a pinion 17 mounted on the shaft 8. Accordingly in the present case the holding parts 14 are belt pulleys, although in principle the drive for the holding parts 14 could be in some other fashion.

At this point it is furthermore to be noted that the machine 1 may in principle comprise more or less than three work plates 9 each with its respectively associated holding part 14. In the case of a single work plate 9 it would be feasible for the holding part to be mounted directly on the drive shaft.

The holding parts 14 constituted by the belt pulleys or, respectively, the bearing pins 15 thereof are all mounted on a common component 18, which is rotatably mounted on the housing 3 coaxially to the drive shaft 8.

On the axis 13 of rotation of the work plate 9 and the axis 20 of rotation of the holding part 14 at a support point 19 adjacent to the center of rotation the respective holding part 14 bears on the work plate 9. In this respect the arrangement is such that the work plate 9 is able to be pivoted obliquely like the moving element of a ball joint in all directions. In the pivoted state the axis 13 of rotation of the work plate 9 is somewhat inclined in relation to the axis 20 of rotation of the holding part 14 which has not been changed in position, the axis 13 of rotation being able to be set as may be desired within a conical surface predetermined by the maximum possible angle of pivot. Radially without the support point 19 the work plate 9 and the holding part 14 are arranged with a clearance permitting pivoting of the work plate 9 as shown in FIG. 1.

In FIG. 1 it is a question of a floor 2 which is even all over. In practice floors to be worked, i.e. more particularly sanded or brushed, frequently have an undulating surface. If the work plates 9 were to be mounted rigidly, then in the case of such uneven floors the working operation would be uneven. In the case of a recess in the floor the respective work plate 9 would move thereover either freely and without engagement or with a reduced engagement thrust. In the case of a projection on the floor the edge of the present might well rip its way into the floor surface. The said pivotal arrangement of the work plate 9 provides a remedy in this case, since the work plate 9 may adapt itself to the unevenness encountered so that a more even surface quality may be achieved.

At the support point 19 the holding part 14 is simply rested on the work plate 9 without any other form of connection so that on lifting the work plate 9 would drop off if no further measures were adopted. Such measures are so designed that the respective work plate 9 is attached at several and preferably three attachment points 21 to the holding part 14 distributed around the central support point 19, such attachment being by way of suspension at each attachment point 21 with axial play. This axial play ensures that at the attachment points 21 even a pivoting of the work plate 9 will not involve any vertical forces being transmitted to the latter, unless the work plate 9 or, respectively, the attachment means strike against the holding part at the end of the pivotal movement.

As regards details in the case of the working embodiment the respective work plate 9 is suspended at one of the attachment points 21, which are evenly distributed out along a circular line, in a fashion preventing relative rotation on the holding part 14 using a retaining pin 22, such pin 22 being secured on the one hand on the holding part 14 and on the other hand on the work plate 9 and in this respect connected with the holding part 14 with axial play. The axial play could, in a manner different to the working embodiment, also be provided at the work plate 9 or both at the holding part 14 and also at the work plate 9.

In this respect it would be feasible for the holding pins 22, of which there are three, corresponding to the number of attachment points 21, to have a tapered pin part 25 in order to obtain the axial play, and which would be limited at its two ends respectively by an abutment surface 23 and 24 effective in the axial direction, on the holding pin, which in the working embodiment is constituted by an annular surface. The tapered pin part 25 fits through a bearing hole 26 in a bearing member 27, mounted on the holding part 14 in the working embodiment, of rubber-like elastic material, the part containing the bearing hole 26 of the bearing member 27 being shorter in the axial direction than the tapered part 25 of the respective holding pin 22 so that there is axial play with a length corresponding to the difference between the length of the tapered pin part 25 and the thickness of the bearing member 27. This differential length is equal to the gap 28 allowing movement indicated in FIG. 1 between the bearing member 27 and the lower abutment surface 24 (see FIG. 3). In connection with this it is pointed out that in FIG. 1 the floor working machine 1 is depicted in a position raised a small distance from the floor with the result that the work plate 9 is suspended on the holding part 14 owing to the upper abutment surface 23 of the holding pin 22 and the gap 28 allowing movement is consequently present underneath the respective bearing member 27. In the lowered state, when the work plates 9 are resting on the floor 2, there is on either side of the bearing member 27 a respective gap allowing movement, such gap being correspondingly smaller than the gap 28 illustrated. The degree to which the respective holding pin 22 is able to be moved axially in the associated bearing member 27 may be comparatively small, since undulations occurring in practice in the floor only require a relatively small pivoting of the work plates 9.

On pivoting of the respective work plate 9 the holding pins 22 assume oblique settings in the same fashion as the axis 13 of rotation. In such oblique settings the bearing members 27 will yield, since they are made of an elastically yielding material.

The bearing members 27 simultaneously constitute elastic abutments for the holding pins 22 on reaching the maximum angle of pivot.

The bearing members 27 are preferably given a frustoconical form and are set in a correspondingly frustoconical holding recess 29 in the holding part 14, the frustoconical form tapering towards the outside. The bearing members 27 are in this fashion locked in a positive manner against dropping out. During assembly the bearing members 27 are thrust into the associated holding recess 29 and thereby elastically deformed.

In the working embodiment the holding pins 22 possess at their end opposite to the tapered pin portion 25, a screw threaded portion 30 screwed into the work plate 9. Furthermore between the tapered pin portion 25 and the screw threaded portion 30 the holding pins 25 possess a polygonal portion 31, which is arranged in the distance part between the holding part 14 and the work plate 9, for the application a spanner or the like so that the respective holding pin may be screwed up tight or slackened off on the work plate 9.

With its end surface facing the tapered pin portion 25, the polygonal portion 31 constitutes the lower abutment surface 24. The opposite abutment surface 23 is constituted by a conical pin head 32, which in the course of assembly may readily be slipped through the respective bearing hole 26.

As regards the suspension of the work plates 9 it would in principle be feasible to adopt the converse arrangement so that the bearing members 27 would be mounted on the work plate 9 and the screw threaded hole receiving the screw threaded portions 30 would be provided in the holding part 14 and the holding pins 22 would be turned around. The depicted design is however appropriate for a number of reasons.

At the central support point 19 the holding part 14 and the work plate 9 respectively possess a support surface 33 and, respectively, 34, on which on pivoting of the work plate 9, there is a rolling movement. Owing to the radial symmetry of the support surfaces 33 and 34 this rolling motion is possible in all directions with the result that in this manner the function of a ball joint is rendered possible without the occurrence of frictional forces. This is advantageous for free running of the pivotal parts.

One of the support surfaces, the support surface 34, may be in the form of the crowned top side of a support projection 35 projecting towards the holding part 14 and arranged on the work plate 9. In this respect the support projection is preferably molded integrally on the work plate 9.

Then in the case of the embodiment of the invention the other support surface 33 is on the contrary flat. It would be feasible in this respect for the arrangement to be reversed, that is to say the crowned support surface would be provided on the holding part and the flat support surface would be on the work plate 9.

A further appropriate measure would be such that the holding part 14 would be supported in an elastically yielding fashion on the work plate 9. This could very simply be provided for if at least one of the support surfaces 33 and 34, in the case of the working embodiment the support surface 33, were constituted by a rubber-like, elastic material as a molding 37. This molding would best be mounted on the holding part 14, although it might well be arranged on the work plate 9 in the case of a reverse arrangement.

The molding 37 can be snap-fitted in the part bearing it, in which respect it would best have a frustoconical configuration and would be inserted in a corresponding holding recess 38 in the part carrying it, the frustoconical configuration tapering towards the outside. To this extent it would be consequently feasible to have the same general design as in the case of the bearing members 27.

I claim:

1. A floor machine for working a surface of a floor comprising:

at least one rotary work plate;

work means for working the floor engaged on a lower side of the rotary work plate;

a holding part connected over said rotary work plate;

wherein the holding part is spaced apart from the work plate outside a support area including a center of rotation located between the holding part and the work plate;

the support area having surface means on the work plate and holding part permitting pivoting of the work plate in relation to the holding part;

wherein a first surface of said surface means is convex and a second surface of said surface means is flat when disengaged from said first surface;

attachment means slidably connected between the work plate and the holding part at positions on the holding part distributed around the support area for transmission of rotation from the holding part to the work plate;

said holding part being driven by a motor of the machine;

at least a part of the weight of the machine bearing through the holding part and the work plate to the floor when in operation;

and wherein said attachment means and support area permit limited movement of the work plate in relation to the holding part on an uneven floor.

2. The floor machine as defined in claim 1, wherein said first surface and said second surface roll against one another on pivotal motion of the work plate when in operation.

3. The floor machine defined in claim 1, wherein said first surface is integrally molded on the work plate or the holding part.

4. The floor machine as defined in claim 1, wherein said second surface bears in an elastic, yielding fashion on the work plate when in operation.

5. The floor machine as defined in claim 1, wherein at least one of the said first or said second surface is constituted by a molding of rubber or other elastic material.

6. The floor machine as defined in claim 5, wherein said molding is arranged on said holding part.

7. The floor machine as defined in claim 5, wherein said molding is snap fitted into said holding part.

8. The floor machine as defined in claim 1, wherein said molding is manufactured with a frustoconical configuration and is inserted into a corresponding frustoconical recess in the holding part, the frustoconical configuration tapering towards an outside of the holding part when the molding is inserted into the recess.

9. The floor machine as defined in claim 1, wherein said attachment means comprises a holding pin, a first end of the holding pin being fixedly engaged to the holding part or to the work plate, and a second end of the holding pin respectively slidably engaged to the holding part or the work plate.

10. The floor machine as defined in claim 9, comprising three of said holding pin.

11. The floor machine as defined in claim 9, wherein the holding pin has a tapering portion extending between two abutments surfaces in an axial direction, said tapering portion extending through a bearing hole in a bearing member mounted on the holding part and manufactured of rubber or other elastic material, a part of the bearing member containing the bearing hole being shorter in an axial direction than the tapering part of the holding pin.

12. The floor machine as defined in claim 11, wherein the bearing member is arranged on the holding part.

13. The floor machine as defined in claim 11, wherein the bearing member possesses a frustoconical configuration and is inserted in a corresponding frustoconical holding recess in the holding part or the work plate, the frustoconical form tapering towards an outside of the holding part when the bearing member is inserted into the recess.

14. The floor machine as defined in claim 11, wherein at an end opposite to the tapered portion, the holding pin possesses a screw threaded portion screwed into the work plate or into the holding part and between the tapered portion and the screw threaded portion there is a polygonal portion for the application of a turning tool, such polygonal portion being arranged between the holding part and the work plate.

15. The floor machine as defined in claim 1, wherein the machine has more than one rotary work plate driven by the motor.

* * * * *